US011557235B1

(12) United States Patent
Rhee et al.

(10) Patent No.: US 11,557,235 B1
(45) Date of Patent: Jan. 17, 2023

(54) SWITCH-BASED GRID FOR RESILIENCY AND YIELD IMPROVEMENT

(71) Applicant: Raytheon Company, Waltham, MA (US)

(72) Inventors: Jehyuk Rhee, Newbury Park, CA (US); Bryan W. Kean, Denver, CO (US); John L. Vampola, Goleta, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 17/644,542

(22) Filed: Dec. 15, 2021

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2330/021* (2013.01); *G09G 2330/08* (2013.01); *G09G 2330/12* (2013.01)

(58) Field of Classification Search
CPC ... G09G 2330/08–12; G09G 2330/021; G09G 3/20
See application file for complete search history.

(56) References Cited

U.S. PATENT DOCUMENTS 3,708,717 A * 1/1973 Fleming ..... G09G 3/12 365/111
6,882,333 B2 * 4/2005 Komura ..... G09G 3/3659 345/98
8,928,560 B2 * 1/2015 Pickett ..... G09G 3/20 345/55
8,947,329 B2 * 2/2015 Choi ..... G09G 3/3233 345/77
8,976,090 B2 * 3/2015 Yamamoto ..... G09G 3/3233 345/212
2010/0066766 A1 * 3/2010 Mancuso ..... G09G 3/20 307/38
2011/0227904 A1 * 9/2011 Choi ..... G09G 3/3291 345/212
2015/0054811 A1 * 2/2015 Azizi ..... G06F 1/3218 345/211
2015/0288907 A1 10/2015 Vampola et al.
2018/0182293 A1 * 6/2018 Chaji ..... G06F 1/3265
2019/0279590 A1 * 9/2019 Takahashi ..... G06F 3/0412
2021/0193050 A1 * 6/2021 Yuan ..... G09G 3/3677

* cited by examiner

*Primary Examiner* — Gene W Lee

(57) ABSTRACT

A device includes multiple row power lines and multiple row control lines arranged in rows, where each row control line corresponds to one of the row power lines. The device also includes multiple column power lines arranged in columns. The device further includes multiple unit cells, where each unit cell is coupled to one of the row power lines and one of the row control lines and selectively coupled to one of the column power lines. In addition, the device includes multiple row power switches and multiple column power switches arranged in pairs, where each pair includes one of the row power switches and one of the column power switches. Each pair is configured to selectively (i) connect a corresponding one of the rows and a corresponding one of the columns or (ii) isolate the corresponding one row and the corresponding one column from each other.

20 Claims, 5 Drawing Sheets

SWITCH-BASED GRID FOR RESILIENCY AND YIELD IMPROVEMENT

TECHNICAL FIELD

This disclosure is generally directed to integrated circuits. More specifically, this disclosure is directed to a switch-based grid for resiliency and yield improvement.

BACKGROUND

Integrated circuits, such as complementary metal-oxide semiconductor (CMOS) integrated circuits, often include multiple circuit elements (such as pixels) arranged in a grid. Operation of such an integrated circuit often includes providing power to each of the individual circuit elements. In some integrated circuits, multiple power supplies are used to provide power to the multiple circuit elements, where each power supply can provide power to a particular subset of the circuit elements. A defect that appears in the integrated circuit (such as a defect created during manufacturing or damage that occurs in a run-time environment, such as by a laser) can cause a short between two or more of the power supplies, which can result in one or more of the circuit elements being non-operable.

SUMMARY

This disclosure provides a switch-based grid for resiliency and yield improvement.

In a first embodiment, a device includes multiple row power lines and multiple row control lines arranged in rows, where each row control line corresponds to one of the row power lines. The device also includes multiple column power lines arranged in columns. The device further includes multiple unit cells, where each unit cell is coupled to one of the row power lines and one of the row control lines and selectively coupled to one of the column power lines. In addition, the device includes multiple row power switches and multiple column power switches arranged in pairs, where each pair includes one of the row power switches and one of the column power switches. Each pair is configured to selectively (i) connect a corresponding one of the rows and a corresponding one of the columns or (ii) isolate the corresponding one row and the corresponding one column from the remaining rows and columns.

In a second embodiment, an integrated circuit includes at least one switch-based grid. The at least one switch-based grid includes multiple row power lines and multiple row control lines arranged in rows, where each row control line corresponds to one of the row power lines. The at least one switch-based grid also includes multiple column power lines arranged in columns. The at least one switch-based grid further includes multiple unit cells, where each unit cell is coupled to one of the row power lines and one of the row control lines and selectively coupled to one of the column power lines. In addition, the at least one switch-based grid includes multiple row power switches and multiple column power switches arranged in pairs, where each pair includes one of the row power switches and one of the column power switches. Each pair is configured to selectively (i) connect a corresponding one of the rows and a corresponding one of the columns or (ii) isolate the corresponding one row and the corresponding one column from the remaining rows and columns.

In a third embodiment, a method includes powering up a grid that includes (i) multiple row power lines and multiple row control lines arranged in rows, where each row control line corresponds to one of the row power lines, (ii) multiple column power lines arranged in columns, and (iii) multiple row power switches and multiple column power switches arranged in pairs, where each pair includes one of the row power switches and one of the column power switches. The method also includes detecting a short in at least one of the rows or at least one of the columns. The method further includes resolving the short by opening one or more of the row power switches or one or more of the column power switches.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
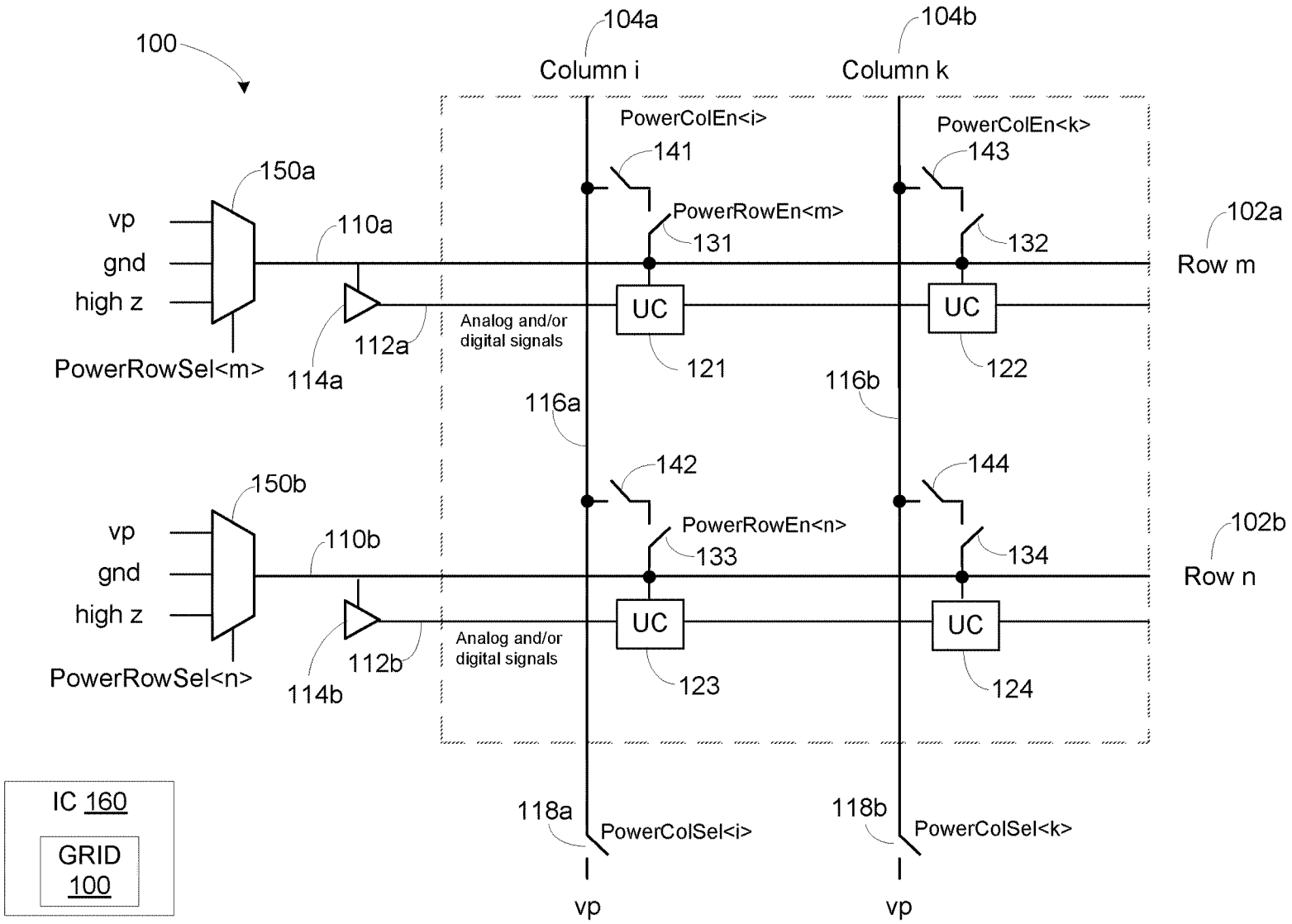
FIG. 1 illustrates an example switch-based grid for resiliency and yield improvement according to this disclosure.

FIGS. 1 through 5, described below, and the various embodiments used to describe the principles of the present disclosure are by way of illustration only and should not be construed in any way to limit the scope of this disclosure. Those skilled in the art will understand that the principles of the present disclosure may be implemented in any type of suitably arranged device or system.

For simplicity and clarity, some features and components are not explicitly shown in every figure, including those illustrated in connection with other figures. It will be understood that all features illustrated in the figures may be employed in any of the embodiments described. Omission of a feature or component from a particular figure is for purposes of simplicity and clarity and is not meant to imply that the feature or component cannot be employed in the embodiments described in connection with that figure. It will be understood that embodiments of this disclosure may include any one, more than one, or all of the features described here. Also, embodiments of this disclosure may additionally or alternatively include other features not listed here.

As discussed above, integrated circuits, such as complementary metal-oxide semiconductor (CMOS) integrated circuits, often include multiple circuit elements (such as pixels) arranged in a grid. Operation of such an integrated circuit often includes providing power to each of the individual circuit elements. In some integrated circuits, multiple power supplies are used to provide power to the multiple circuit elements, where each power supply can provide power to a particular subset of the circuit elements. A defect that appears in the integrated circuit (such as a defect created during manufacturing or damage that occurs in a run-time environment, such as by a laser) can cause a short between two or more of the power supplies, which can result in one or more of the circuit elements being non-operable. Some techniques for addressing these types of shorts include utilizing high-impedance column-based power routing, turning off one or more power supplies, and utilizing column-based current limits. However, some circuits require a low-resistance power supply, which makes these techniques unsuitable.

This disclosure provides a switch-based array or grid for resiliency and yield improvement. The disclosed embodiments utilize switches within each row or column to deliver power to that row or column. The switches are controlled via row and column control signals. The row and column control signals allow power levels to be modified depending on the occurrence of short-circuit conditions. The disclosed embodiments are advantageous over conventional techniques because the disclosed embodiments allow power to be delivered row-wise or column-wise to a non-defective portion of the array or grid, thereby allowing low-impedance power delivery while skipping defective portions of the array or grid. In addition, the disclosed switches can be carefully selected so that, if one or more control signals have a defect, the overall integrated circuit will not contain a low-impedance (and possibly chip damaging) short circuit.

Note that while this disclosure is described with respect to CMOS integrated circuits, it will be understood that the principles disclosed here are also applicable to other types of circuits. The disclosed embodiments can be used in conjunction with various applications that use integrated circuits having an array of elements with multiple power supplies. In addition, the disclosed embodiments can be used in conjunction with various applications that use multiple independent circuit blocks that are not arrays and/or not non-regular in shape.

FIG. 1 illustrates an example switch-based grid 100 for resiliency and yield improvement according to this disclosure. In some embodiments, the grid 100 represents at least a portion of an integrated circuit 160, such as a CMOS integrated circuit. The grid 100 provides a low-impedance power supply to an array of elements, thus enabling use of advanced circuitry (such as digital pixels) within the array not achievable with conventional techniques. As described below, the grid 100 allows the integrated circuit 160 to have multiple low-impedance supplies that are less susceptible to low-impedance short circuits, thus making the integrated circuit 160 more resilient to defects arising during manufacture or damage that can be caused during operation, such as by very strong directed energy (like a laser beam) impinging on the integrated circuit 160.

As shown in FIG. 1, the grid 100 includes multiple rows 102*a*-102*b* and multiple columns 104*a*-104*b*. While two rows 102*a*-102*b* and two columns 104*a*-104*b* are shown, this is merely for ease of illustration and explanation. The grid 100 can include additional rows and/or additional columns as needed or desired. It will be understood that typical grids include much greater numbers (such as hundreds or thousands) of rows and columns. In FIG. 1, the rows 102*a*-102*b* are shown as horizontal lines, and the columns 104*a*-104*b* are shown as vertical lines, although the opposite arrangement may be used. It is noted that in FIG. 1, the intersection of a vertical line and a horizontal line does not mean that the vertical line and horizontal line are physically or electrically connected. In FIG. 1, electrical connections are designated by small circles.

Each combination of row 102*a*-102*b* and column 104*a*-104*b* is associated with a corresponding unit cell (UC) 121-124. For example, the unit cell 121 is associated with row 102*a* and column 104*a*, the unit cell 122 is associated with row 102*a* and column 104*b*, the unit cell 123 is associated with row 102*b* and column 104*a*, and the unit cell 124 is associated with row 102*b* and column 104*b*. In some embodiments, each unit cell 121-124 represents a pixel in a display.

Each row 102*a*-102*b* includes a row power line 110*a*-110*b* and a row control line 112*a*-112*b*. Power for each unit cell 121-124 is provided through the associated row power line 110*a*-110*b* coupled to the unit cell 121-124. Each row control line 112*a*-112*b* is configured to carry one or more analog or digital signals for controlling operation of the UCs 121-124 that are part of the corresponding row 102*a*-102*b*. The analog or digital signals can include any suitable signal(s), such as a clock signal, an intermediate voltage signal, and the like. While FIG. 1 only shows row control lines 112*a*-112*b* corresponding to the rows 102*a*-102*b*, the grid 100 may additionally include a column control line corresponding to each of the columns 104*a*-104*b* in some embodiments.

Each row control line 112*a*-112*b* is coupled to a corresponding control signal driver 114*a*-114*b*. The control signal drivers 114*a*-114*b* represent any suitable circuitry and/or programming for generating and propagating bias and control signals over the corresponding row control lines 112*a*-112*b*. Each control signal driver 114*a*-114*b* is powered by the corresponding row power line 110*a*-110*b*.

Each row power line 110*a*-110*b* is coupled to a multiplexer 150*a*-150*b*. Each multiplexer 150*a*-150*b* is programmable to connect the corresponding row line power 110*a*-110*b* (and thus the corresponding row 102*a*-102*b*) to different voltage or impedance levels (such as a source voltage vp, ground, or high impedance). While FIG. 1 only shows multiplexers 150*a*-150*b* corresponding to the rows 102*a*-102*b*, the grid 100 may additionally include a multiplexer corresponding to each of the columns 104*a*-104*b* in some embodiments.

Each column 104*a*-104*b* includes a corresponding column power line 116*a*-116*b*. Each column power line 116*a*-116*b* is coupled to a column power line switch 118*a*-118*b*. Each column power line switch 118*a*-118*b* can be opened to isolate the corresponding column power line 116*a*-116*b* from the supply voltage vp and set the column power line 116*a*-116*b* to high impedance. Each column power line switch 118*a*-118*b* can also be closed to connect the corresponding column power line 116*a*-116*b* to the power supply vp and set the column power line 116*a*-116*b* to low impedance.

The grid 100 also includes multiple row power switches 131-134 and multiple column power switches 141-144. The row power switches 131-134 and the column power switch 141-144 are arranged in pairs, where each pair is operable to couple a corresponding row 102*a*-102*b* to a corresponding column 104*a*-104*b*. For example, the row power switch 131 and the column power switch 141 are operable to couple the row 102*a* to the column 104*a*. When the row power switch 131 and the column power switch 141 are both closed, the row 102*a* is electrically connected to the column 104*a*. When the row power switch 131, the column power switch 141, or both are open, the row 102*a* is electrically isolated from the column 104*a*. In some embodiments, the row power switches 131-134 and column power switches 141-

144 are transistors (such as NMOS transistors), although other types of switches are possible and within the scope of this disclosure.

By turning on a combination of a row power switch 131-134 and a column power switch 141-144 (such as closing the switches), the row and column power supply lines are connected, and there is low impedance from the power supply to the corresponding unit cells 121-124. If either or both of the row power switch 131-134 and the column power switch 141-144 is opened, the row and column power supply lines are not connected, and there is a high impedance to the corresponding unit cell 121-124.

Using the switch-based grid 100 described here, it is possible to disconnect a single affected row power line 110*a*-110*b* or column power line 116*a*-116*b* from the grid 100 in the event of a short. Thus, only an affected row 102*a*-102*b* or column 104*a*-104*b* would be disabled instead of the full array in order to prevent any unwanted effects from the short circuit. The grid 100 prevents an entire array outage caused by a short circuit while allowing low-impedance grid power routing for the remaining portion of the array. The grid 100 retains the low resistance of a grid, but each grid element is programmable. The grid 100 also provides for various voltages and currents to each row/column bias and power supply to allow preferential short circuits. This may be useful or desirable for various circuits, such as those with large dynamic currents.

Figure 2:
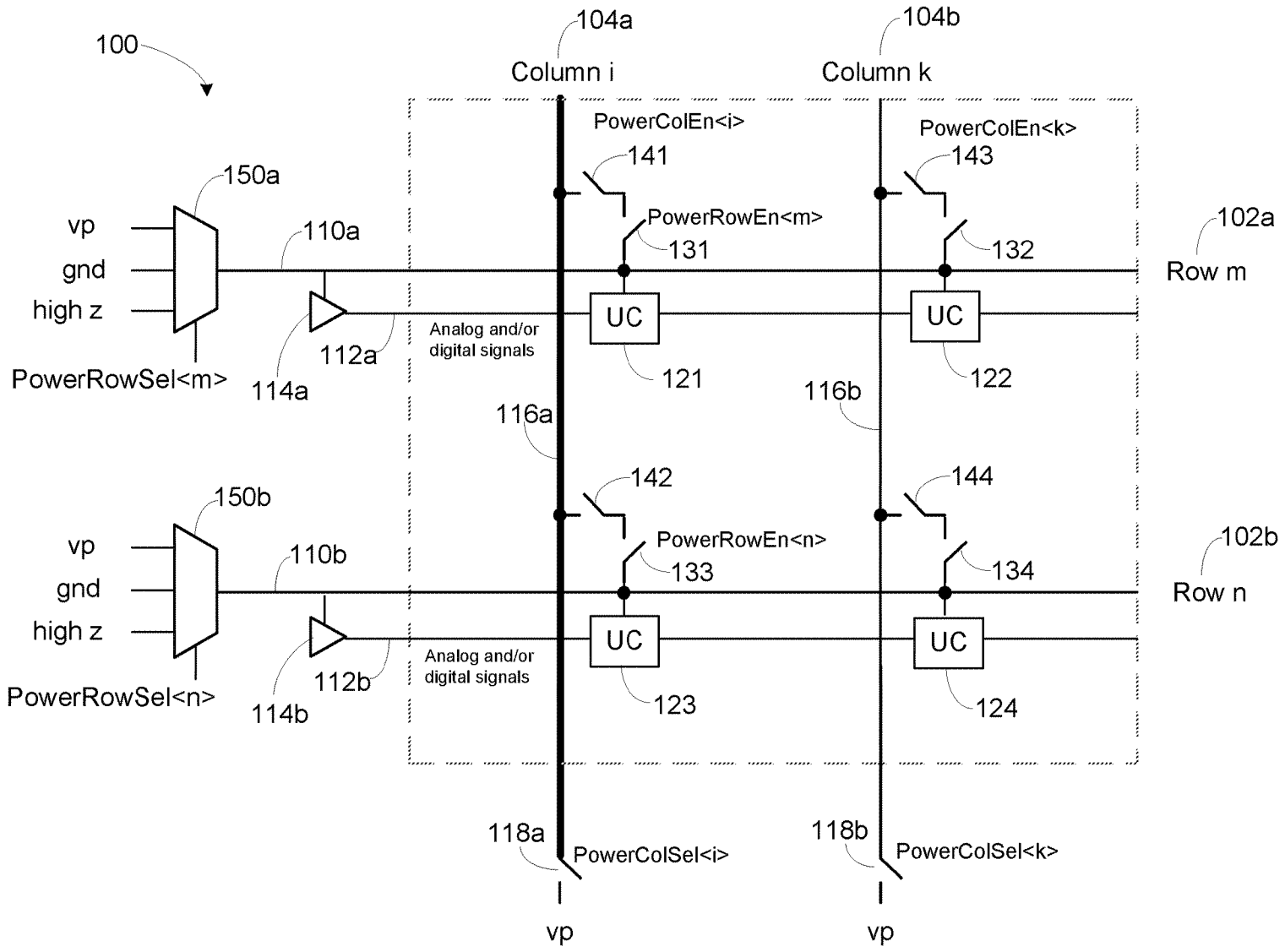
FIG. 2 illustrates an example of the switch-based grid of FIG. 1 with a short on a column power line according to this disclosure.

FIG. 2 illustrates an example of the switch-based grid 100 with a short on a column power line 116*a*-116*b* according to this disclosure. For ease of explanation, it is assumed that the short is on the column power line 116*a*, which is shown with a bold line in FIG. 2. It will be understood that the short may occur on any of the column power lines 116*a*-116*b*. The short on the column power line 116*a* can occur between the column power line 116*a* and various other portions of the grid 100. Several examples of such a short will now be described.

As a first example, the short can occur between the column power line 116*a* and an internal low-impedance node, such as the unit cell 121 or the unit cell 123. If this short occurs, the column power line 116*a* is disconnected from the grid 100 by the column power switches 141 and 142 that are associated with the column power line 116*a*. In addition, the column power line 116*a* is tied to high impedance by opening the column power line switch 118*a*. Only the column power line 116*a* may be disconnected from the grid 100. All columns and rows retain power. The disconnection of the column power line 116*a* may result in some performance degradation on the unit cell 121 or 123 that is shorted with the column power line 116*a* due to large loading of the column power line 116*a*. In some embodiments, the column power line 116*a* can be tied to high impedance by opening the column power line switch 118*a*.

As a second example, the short can occur between the column power line 116*a* and another, separate column power line (not shown) or a column control line (not shown). If this short occurs, the column power line 116*a* is disconnected from the grid 100 by the column power switches 141 and 142 that are associated with the column power line 116*a*. In addition, the column power line 116*a* is tied to high impedance by opening the column power line switch 118*a*. Only the column power line 116*a* may be disconnected from the grid 100. All columns and rows retain power. The disconnection of the column power line 116*a* may result in some performance on the column power supply that is shorted with the column power line 116*a* due to large loading of the column power line 116*a*. In some embodiments, the column power line 116*a* can be tied to high impedance by opening the column power line switch 118*a*.

As a third example, the short can occur between the column power line 116*a* and one of the row control lines 112*a*-112*b*. If this short occurs, the column power line 116*a* is disconnected from the grid 100 by the column power switches 141 and 142 that are associated with the column power line 116*a*. In addition, the column power line 116*a* is tied to high impedance by opening the column power line switch 118*a*. Only the column power line 116*a* may be disconnected from the grid 100. The disconnection of the column power line 116*a* may result in some performance degradation on the affected row control line 112*a*-112*b* due to large loading of the column power line 116*a*.

In each of these examples, only the column power lines with a short are disconnected from the grid 100. There is no widespread outage to the grid 100 from a short on the column power line 116*a*. This can allow for effective operation and usage of the grid 100 even in the presence of the short on the column power line 116*a*.

Figure 3:
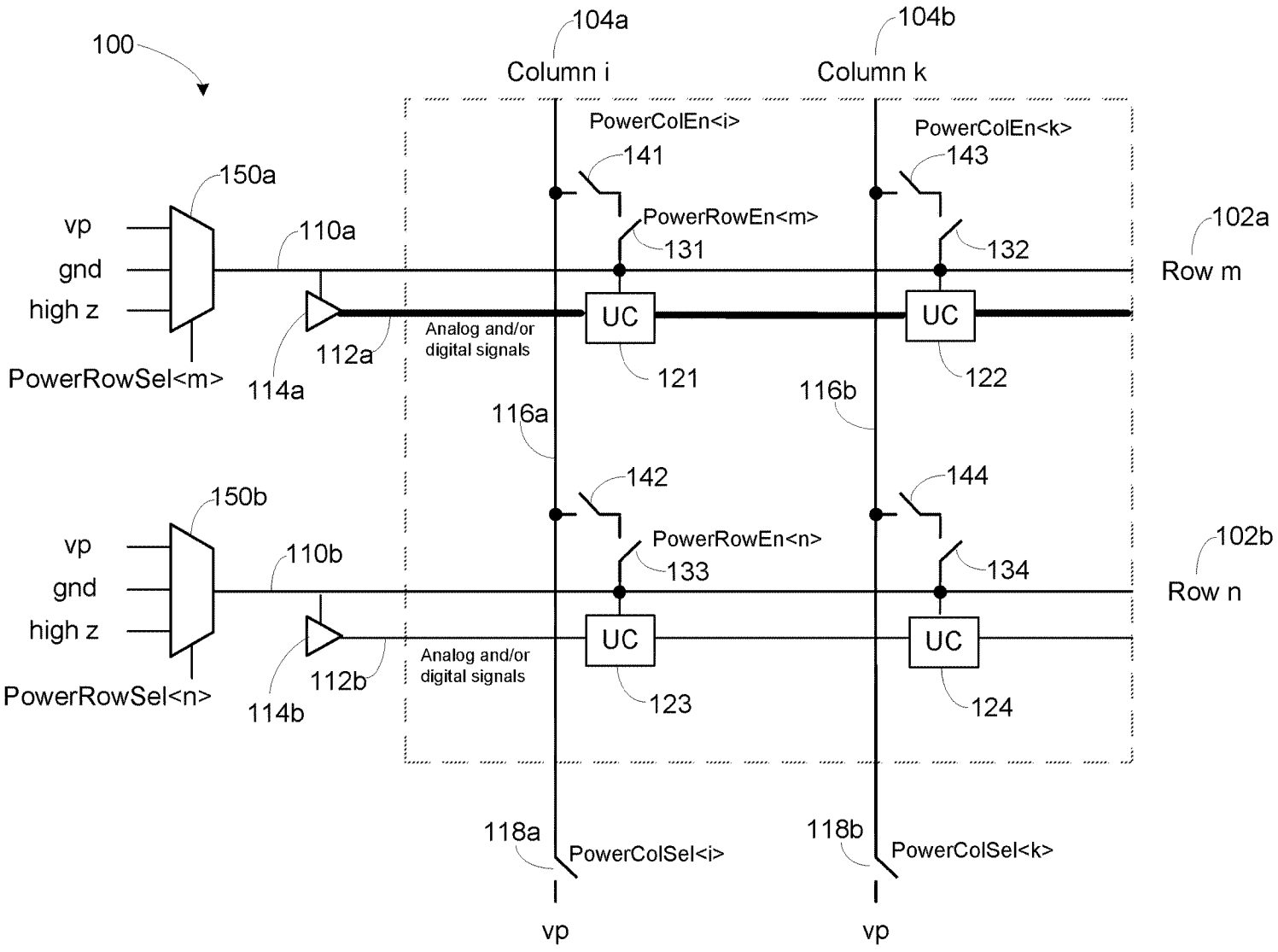
FIG. 3 illustrates an example of the switch-based grid of FIG. 1 with a short on a row control line according to this disclosure.

FIG. 3 illustrates an example of the switch-based grid 100 with a short on a row control line 112*a*-112*b* according to this disclosure. For ease of explanation, it is assumed that the short is on the row control line 112*a*, which is shown with a bold line in FIG. 3. It will be understood that the short may occur on any of the row control lines 112*a*-112*b*. The short on the row control line 112*a* can occur between the row control line 112*a* and various other portions of the grid 100. Several examples of such a short will now be described.

As a first example, the short can occur between the row control line 112*a* and an internal low-impedance node, such as the unit cell 121 or the unit cell 122. If this short occurs, only the unit cell 121 or 122 with the short may be affected. No action may be needed to protect any other portion of the grid 100.

As a second example, the short can occur between the row control line 112*a* and a row power line 110*a*-110*b* or another, separate row control line (not shown). If this short occurs and if high current is not observed, no action may be needed. Often times, only the corresponding row 102*a* may be affected by the short. However, if the short causes a problem on any neighboring rows (such as the row 102*b*) or larger portions of the grid 100, the shorted row power line 110*a* is disconnected from the grid 100 by operation of the row power switches 131 and 132, and the corresponding row 102*a* is shut down by tying the row power line 110*a* to ground or high impedance. This results in a loss of only a row 102*a* and a row power line 110*a*.

As a third example, the short can occur between the row control line 112*a* and one of the column power lines 116*a*-116*b*. For ease of explanation, it is assumed that the column power line 116*a* is shorted. Often times, only the corresponding row 102*a* may be affected by the short. However, if high current is observed, the shorted column power line 116*a* is disconnected from the grid 100 by operation of the corresponding column power switches 141-142, and the column power line 116*a* is set to high impedance. In this example, only the shorted column power line 116*a* is lost. The disconnection of the column power line 116*a* may result in some performance degradation on the affected row 102*a* due to large loading of the column power line 116*a*.

As a fourth example, the short can occur between the row control line 112*a* and a column control line (not shown). In the event of such a short, only the corresponding row 102*a* and/or the column (such as the column 104*a*-104*b* corresponding to the column control line) may be affected. If the short causes a problem on any neighboring rows (such as the row 102*b*) or any larger portions of the grid 100, the shorted row power line 110*a* is disconnected from the grid 100 by operation of the row power switches 131 and 132, and the corresponding row 102*a* is shut down by tying the row power line 110*a* to ground. This results in a loss of only a row 102*a*, a row power line 110*a*, and a column (such as one of the columns 104*a*-104*b*).

In each of these examples, the loss of power is limited, usually only to the row 102*a*. There is no widespread outage to the grid 100 from a short on the row control line 112*a*. This can allow for effective operation and usage of the grid 100 even in the presence of the short on the row control line 112*a*.

Figure 4:
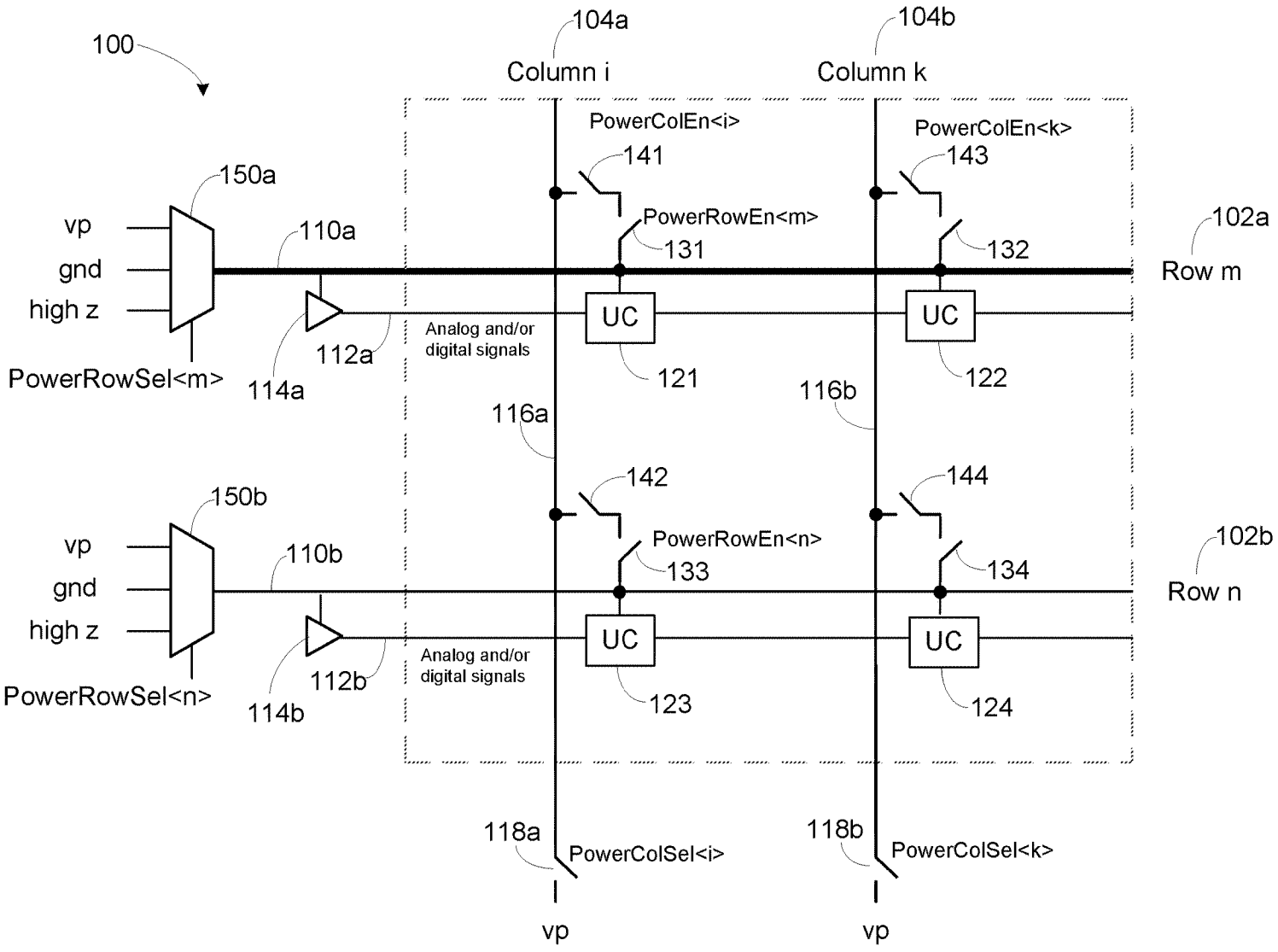
FIG. 4 illustrates an example of the switch-based grid of FIG. 1 with a short on a row power line according to this disclosure.

FIG. 4 illustrates an example of the switch-based grid 100 with a short on a row power line 110*a*-110*b* according to this disclosure. For ease of explanation, it is assumed that the short is on the row power line 110*a*, which is shown with a bold line in FIG. 4. It will be understood that the short may occur on any of the row power lines 110*a*-110*b*. The short on the row power line 110*a* can occur between the row power line 110*a* and various other portions of the grid 100. Several examples of such a short will now be described.

As a first example, the short can occur between the row power line 110*a* and an internal low-impedance node, such as the unit cell 121 or the unit cell 122. If this short occurs, only the unit cell 121 or 122 with the short may be affected. No action may be needed to protect any other portion of the grid 100.

As a second example, the short can occur between the row power line 110*a* and another, separate power supply. If this short occurs, one or both of the affected row power lines is disconnected from the grid 100 by operation of the corresponding switches (e.g., the row power switches 131 and 132 are shut down by tying the row power line 110*a* to ground or high impedance).

As a third example, the short can occur between the row power line 110*a* and a row control line (such as the row control line 112*a*). If this short occurs, only the corresponding row 102*a* may be affected by the short. However, if the short causes a problem on any neighboring rows (such as the row 102*b*) or any larger portions of the grid 100, the shorted row power line 110*a* is disconnected from the grid 100 by operation of the row power switches 131 and 132. This results in only a loss of the row power line 110*a* and the row control line 112*a*.

As a fourth example, the short can occur between the row power line 110*a* and one of the column power lines 116*a*-116*b*. For ease of explanation, it is assumed that the column power line 116*a* is shorted. In the event of such a short, the shorted column power line 116*a* is disconnected from the grid 100 by operation of the corresponding column power switches 141-142, and the column power line 116*a* is set to high impedance. This results in a loss of only the shorted column power line 116*a*.

As a fifth example, the short can occur between the row power line 110*a* and a column control line (not shown). In the event of such a short, only the corresponding row 102*a* and/or the column (such as the column 104*a*-104*b* corresponding to the column control line) may be affected. If the short causes a problem on any neighboring rows (such as the row 102*b*) or any larger portions of the grid 100, the shorted row power line 110*a* is disconnected from the grid 100 by operation of the row power switches 131 and 132, and the corresponding row 102*a* is shut down by tying the row power line 110*a* to ground. This results in a loss of only a row 102*a*, a row power line 110*a*, and a column (such as one of the columns 104*a*-104*b*).

Although FIGS. 1 through 4 illustrate examples of a switch-based grid 100 and related details, various changes may be made to FIGS. 1 through 4. For example, to reduce the likelihood of shorting of the row control lines 112*a*-112*b*, the row control lines 112*a*-112*b* can be routed as low as possible within the metal stack-up. Also, to reduce the chances of developing a short, PMOS devices can be used for the power supply switches, and NMOS devices can be used for the ground switches. In some embodiments, one or more regulators can be implemented in each row 102*a*-102*b* or column 104*a*-104*b* to control impedance and allow for preferential shorting. Also, to detect large-scale shorts and allow preferential shorting, the row control lines 112*a*-112*b* can be routed within the same layer as the power supply. In addition, various components in the grid 100 may be combined, further subdivided, replicated, rearranged, or omitted and additional components may be added according to particular needs.

Figure 5:
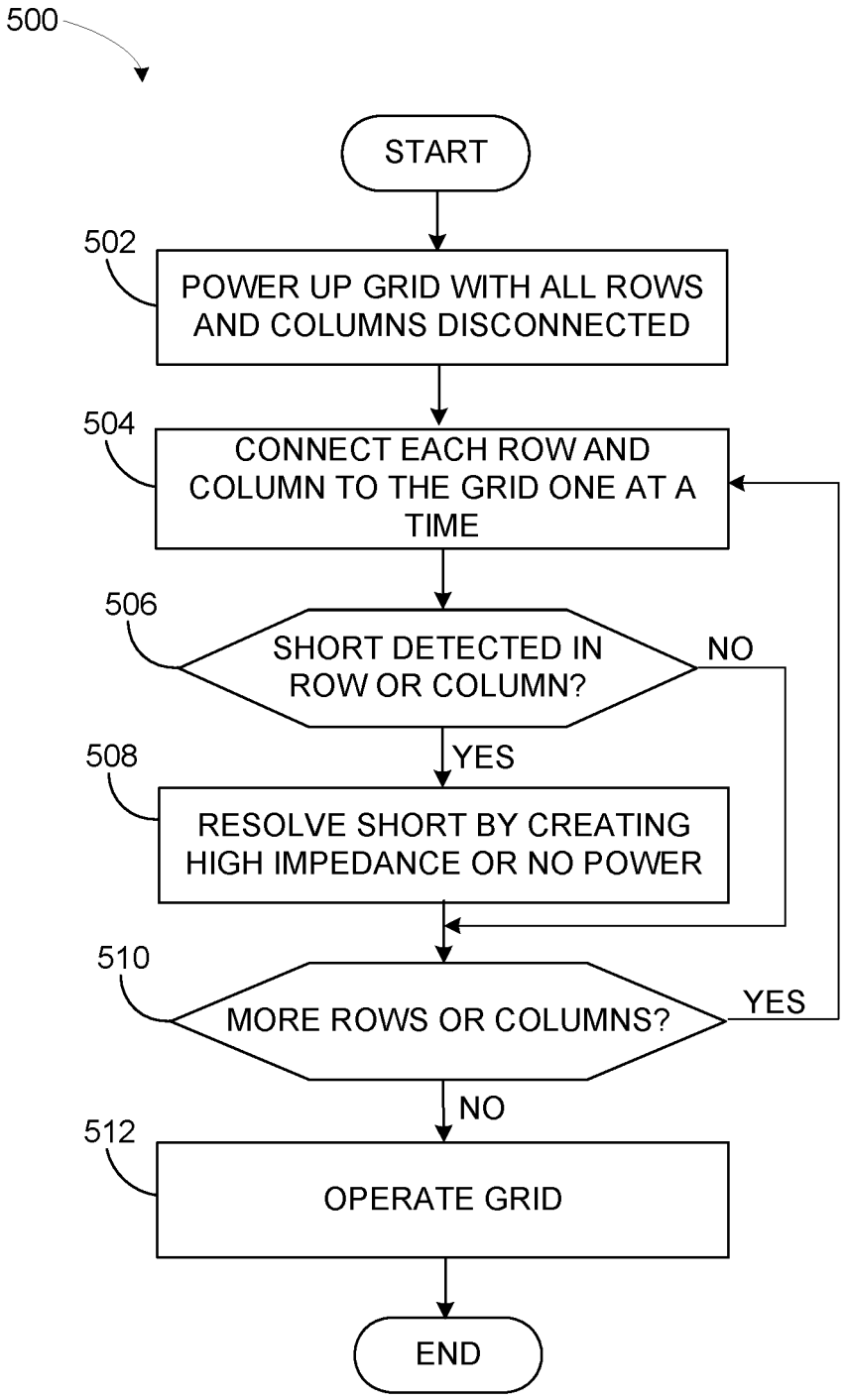
FIG. 5 illustrates an example method for resolving a short in an integrated circuit according to this disclosure.

FIG. 5 illustrates an example method 500 for resolving a short in an integrated circuit according to this disclosure. For ease of explanation, the method 500 is described as being performed using the switch-based grid 100 of FIG. 1. However, the method 500 may be used to resolve a short in any other suitable integrated circuit.

As shown in FIG. 5, a switch-based grid of an integrated circuit is powered up with all rows and columns disconnected at step 502. This may include, for example, an operator or automated system turning on the grid 100 with all rows 102*a*-102*b* and columns 104*a*-104*b* disconnected from the grid 100. This can be achieved by having all row power switches 131-134 and all column power switches 141-144 open. In some embodiments, the grid 100 is turned on as part of a manufacturing or installation test of the integrated circuit. In other embodiments, the grid 100 is turned on during a run-time operation period after a damaging event (such as a laser beam impinging on the integrated circuit) causes a short somewhere in the integrated circuit. Each row and column is connected to the grid one at a time at step 504. This may include, for example, the operator or automated system connecting each row 102*a*-102*b* and column 104*a*-104*b* to the grid 100 by closing corresponding row power switches 131-134 or column power switches 141-144.

A determination is made whether a short is detected in a row or column at step 506. This may include, for example, the operator or automated system detecting a higher-than-expected current level in one of the rows 102*a*-102*b* or columns 104*a*-104*b*. If a short is detected, the detected short is resolved by creating a high impedance path or turning off power at step 508. This may include, for example, setting the shorted row 102*a*-102*b* or column 104*a*-104*b* to high impedance or turning off power to the shorted row 102*a*-102*b* or column 104*a*-104*b*. As a particular example, the shorted row 102*a*-102*b* or column 104*a*-104*b* can be set to high impedance by opening one or more row power switches 131-134 or column power switches 141-144, such as described in conjunction with FIGS. 2 through 4.

A determination is made whether there are additional rows or columns to connect at step 510. This may include, for example, the operator or automated system determining if any more rows 102*a*-102*b* or columns 104*a*-104*b* need to be connected to the grid 100. If there are additional rows or columns to connect, the method 500 returns to step 504. Otherwise, the grid is operated after resolving the short at step 512. This may include, for example, the operator or automated system operating the grid 100 with the short resolved. While one row 102*a*-102*b* or column 104*a*-104*b* may be disabled by the remedy, the remaining portions of the grid 100 can operate correctly with no shorting conditions.

Although FIG. 5 illustrates one example of a method 500 for resolving a short in an integrated circuit, various changes may be made to FIG. 5. For example, while shown as a series of steps, various steps in FIG. 5 may overlap, occur in parallel, occur in a different order, or occur any number of times.

In some embodiments, various functions described in this patent document are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory.

It may be advantageous to set forth definitions of certain words and phrases used throughout this patent document. The terms "application" and "program" refer to one or more computer programs, software components, sets of instructions, procedures, functions, objects, classes, instances, related data, or a portion thereof adapted for implementation in a suitable computer code (including source code, object code, or executable code). The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present disclosure should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A device comprising:

multiple row power lines and multiple row control lines arranged in rows, each row control line corresponding to one of the row power lines;

multiple column power lines arranged in columns;

multiple unit cells, each unit cell coupled to one of the row power lines and one of the row control lines and selectively coupled to one of the column power lines;

multiple row power switches and multiple column power switches arranged in pairs, each pair comprising one of the row power switches and one of the column power switches, each pair configured to selectively (i) connect a corresponding one of the rows and a corresponding one of the columns or (ii) isolate the corresponding one row and the corresponding one column from each other; and multiple column power line switches, each column power line switch coupled to a corresponding one of the column power lines and configured to selectively (i) connect the corresponding column power line to a power supply or (ii) isolate the corresponding column power line from the power supply.

2. The device of claim 1, wherein each row control line is configured to carry one or more analog or digital signals for controlling operation of at least one of the unit cells.

3. The device of claim 2, further comprising:

multiple control signal drivers, each control signal driver coupled to one of the row control lines and configured to generate the one or more analog or digital signals.

4. The device of claim 1, further comprising:

multiple programmable multiplexers, each multiplexer coupled to a corresponding one of the row power lines and configured to connect the corresponding row power line to different voltage or impedance levels.

5. The device of claim 1, wherein, upon detection of a short on a particular column power line among the multiple column power lines, the column power switches corresponding to the particular column power line are configured to open to disconnect the particular column power line.

6. The device of claim 1, wherein each unit cell comprises a pixel in a display.

7. A device comprising:

multiple row power lines and multiple row control lines arranged in rows, each row control line corresponding to one of the row power lines;

multiple column power lines arranged in columns;

multiple unit cells, each unit cell coupled to one of the row power lines and one of the row control lines and selectively coupled to one of the column power lines; and multiple row power switches and multiple column power switches arranged in pairs, each pair comprising one of the row power switches and one of the column power switches, each pair configured to selectively (i) connect a corresponding one of the rows and a corresponding one of the columns or (ii) isolate the corresponding one row and the corresponding one column from each other;

wherein, upon detection of a short on a particular row control line among the multiple row control lines, the row power switches corresponding to the particular row control line are configured to open to disconnect the particular row control line.

8. The device of claim 7, further comprising:

multiple column power line switches, each column power line switch coupled to a corresponding one of the column power lines and configured to connect the corresponding column power line to a power supply or isolate the corresponding column power line from the power supply.

9. An integrated circuit comprising:

at least one switch-based grid comprising:

multiple row power lines and multiple row control lines arranged in rows, each row control line corresponding to one of the row power lines;

multiple column power lines arranged in columns;

multiple unit cells, each unit cell coupled to one of the row power lines and one of the row control lines and selectively coupled to one of the column power lines;

multiple row power switches and multiple column power switches arranged in pairs, each pair comprising one of the row power switches and one of the column power switches, each pair configured to selectively (i) connect a corresponding one of the rows and a corresponding one of the columns or (ii) isolate the corresponding one row and the corresponding one column from each other;

wherein, upon detection of a short on a particular column power line among the multiple column power lines, the column power switches corresponding to the particular column power line are configured to open to disconnect the particular column power line.

10. The integrated circuit of claim 9, wherein each row control line is configured to carry one or more analog or digital signals for controlling operation of at least one of the unit cells.

11. The integrated circuit of claim 10, further comprising:

multiple control signal drivers, each control signal driver coupled to one of the row control lines and configured to generate the one or more analog or digital signals.

12. The integrated circuit of claim 9, further comprising:

multiple programmable multiplexers, each multiplexer coupled to a corresponding one of the row power lines and configured to connect the corresponding row power line to different voltage or impedance levels.

13. The integrated circuit of claim 9, further comprising:

multiple column power line switches, each column power line switch coupled to a corresponding one of the column power lines and configured to connect the corresponding column power line to a power supply or isolate the corresponding column power line from the power supply.

14. The integrated circuit of claim 9, wherein, upon detection of a short on a particular row control line among the multiple row control lines, the row power switches corresponding to the particular row control line are configured to open to disconnect the particular row control line.

15. The integrated circuit of claim 9, wherein each unit cell comprises a pixel in a display.

16. A method comprising:

powering up a grid that includes (i) multiple row power lines and multiple row control lines arranged in rows, each row control line corresponding to one of the row power lines, (ii) multiple column power lines arranged in columns, and (iii) multiple row power switches and multiple column power switches arranged in pairs, each pair comprising one of the row power switches and one of the column power switches;

detecting a short in at least one of the rows or at least one of the columns; and resolving the short by opening one or more of the row power switches or one or more of the column power switches.

17. The method of claim 16, further comprising:

operating the grid after resolving the short.

18. The method of claim 16, wherein:

the grid further includes multiple unit cells, each unit cell coupled to one of the row power lines and one of the row control lines and selectively coupled to one of the column power lines; and each row control line is configured to carry one or more analog or digital signals for controlling operation of at least one of the unit cells.

19. The method of claim 18, wherein the grid further includes multiple control signal drivers, each control signal driver coupled to one of the row control lines and configured to generate the one or more analog or digital signals.

20. The method of claim 16, wherein the grid further comprises multiple programmable multiplexers, each multiplexer coupled to a corresponding one of the row power lines and configured to connect the corresponding row power line to different voltage or impedance levels.

* * * * *